US008746933B2

(12) United States Patent
Cho et al.

(10) Patent No.: US 8,746,933 B2
(45) Date of Patent: Jun. 10, 2014

(54) LIGHTING APPARATUS

(75) Inventors: Beom Yeon Cho, Seoul (KR); Bon Koan Jung, Yangju-si (KR)

(73) Assignee: Feelux Co., Ltd., Gyeonggi-do (KR)

( * ) Notice: Subject to any disclaimer, the term of this patent is extended or adjusted under 35 U.S.C. 154(b) by 502 days.

(21) Appl. No.: 13/093,483

(22) Filed: Apr. 25, 2011

(65) Prior Publication Data

US 2012/0092875 A1 Apr. 19, 2012

(30) Foreign Application Priority Data

Oct. 19, 2010 (KR) ..... 10-2010-0102031
Feb. 21, 2011 (KR) ..... 10-2011-0015147

(51) Int. Cl.
*F21V 1/00* (2006.01)

(52) U.S. Cl.
USPC ..... 362/311.01; 362/249.1; 362/249.02; 362/235

(58) Field of Classification Search
USPC ..... 362/249.02, 249.1, 249.11, 311.01, 235
See application file for complete search history.

(56) References Cited

U.S. PATENT DOCUMENTS 8,388,177 B2 * 3/2013 Park et al. ..... 362/235
2008/0314944 A1 12/2008 Tsai et al.
2010/0053956 A1 3/2010 Park et al.
2010/0073929 A1 3/2010 Gingrich
2010/0135020 A1 6/2010 Moore

FOREIGN PATENT DOCUMENTS

| | | | |
|---|---|---|---|
| CN | 1279755 | A | 1/2001 |
| CN | 101644421 | A | 2/2010 |
| EP | 1139008 | A2 | 10/2001 |
| EP | 1 519 186 | A2 | 3/2005 |
| EP | 2 209 165 | A1 | 7/2010 |
| EP | 2 442 008 | A2 | 4/2012 |
| KR | 20-2009-0006633 | U | 7/2009 |

OTHER PUBLICATIONS

European Search Report dated Aug. 2, 2013 from EPO in a counterpart foreign application.
Office action from KIPO in a counterpart foreign application, citing US20080314944 and KR20-2009-0006633.
Office action issued on Oct. 29, 2013 from Chinese Patent Office in a counterpart Chinese application.
Search Report issued on Oct. 20, 2013 from Chinese Patent Office in a counterpart Chinese application.

* cited by examiner

*Primary Examiner* — Anabel Ton
(74) *Attorney, Agent, or Firm* — The PL Law Group, PLLC

(57) ABSTRACT

A lighting apparatus is configured to expose one end of a substrate in which a electrode pad is formed, and to combine a coupling unit in which a locking ledge is formed. The other end of the substrate is placed atop one end of another lighting apparatus at which an electrode pad is exposed, and the locking ledge of the lighting apparatus is locked into a locking groove of the another lighting apparatus.

19 Claims, 8 Drawing Sheets

LIGHTING APPARATUS

CROSS-REFERENCE TO RELATED APPLICATION AND CLAIM OF PRIORITY

This application claims the benefit of Korean Patent Application Nos. 10-2010-0102031 filed on Oct. 19, 2010 and 10-2011-0015147 filed on Feb. 21, 2011, in the Korean Patent and Trademark Office, the disclosures of which are incorporated herein in their entirety by reference.

BACKGROUND

1. Field of the Invention

The present invention relates to a lighting apparatus.

2. Description of the Related Art

Light emitting diodes (LEDs) have advantages of reduced size and longer lifespan (approximately between 50,000 to 100,000 hours) when compared with conventional light sources such as incandescent lamps or fluorescent lamps. The LEDs also have superior energy efficiency and reduced energy power consumption, because the electric energy is converted directly to the light energy. Therefore, the light emitting diodes are widely used as light sources for various kinds of displays, as well as for indoor/outdoor lights, signboards, household lights, etc.

When the LEDs are used as lighting equipments, they can be implemented as bar type LED modules which have several light emitting diodes attached on printed circuit boards (PCBs). Such bar type LED modules are mainly designed to use in connection with other bar type LED modules which are positioned next to each other, so there are growing concerns about connecting the adjoining bar type LED modules easily and firmly.

SUMMARY

The present invention is to provide a lighting apparatus which can be connected with adjoining lighting apparatuses easily and securely.

According to an embodiment of the present invention, there is provided a lighting apparatus for use in combination with another lighting apparatus, including a lighting unit having a substrate having a first end and a second end opposite to the first end, a light emitting element formed on the substrate, an electrode pad formed at the first end of the substrate and a connection terminal formed at the second end of the substrate, a housing unit that houses the light unit, and a coupling unit coupled to the housing unit at the second end of the substrate, wherein the lighting apparatus is vertically inserted to another lighting apparatus through the coupling unit.

According to another embodiment of the present invention, there is provided a lighting apparatus for use in combination with another lighting apparatus, including: a lighting unit including: a substrate having a first end and a second end opposite to the first end, the substrate having a pair of locking grooves formed on both side of the substrate in the vicinity of the first end; a light emitting element formed on the substrate; an electrode pad formed at the first end of the substrate; and a connection terminal formed at the second end of the substrate; a housing unit that houses the lighting unit; and a coupling unit coupled to the housing unit at the second end of the substrate, the coupling unit includes: a body; a pair of lateral projections protruding from both sides of the body in a direction opposite to the housing; a pair of locking ledges facing each other and protruding horizontally on the lateral projections to be coupled to a pair of locking grooves of another lighting apparatus; and a connection terminal inserting hole formed in the body to receive the connection terminal.

According to another embodiment of the present invention, a lighting apparatus for use in combination with another lighting apparatus, including: a lighting unit including: a substrate having a first end and a second end opposite to the first end; a light emitting element formed on the substrate; an electrode pad formed at the first end of the substrate; and a connection terminal formed at the second end of the substrate; a housing unit that houses the lighting unit; a coupling unit coupled to the housing unit at the second end of the substrate, the coupling unit includes: a body; a pair of lateral projections protruding from both sides of the body in a direction opposite to the housing; an elasticity-providing groove formed on each of the lateral projections to provide elasticity to the lateral projections; and a connection terminal inserting hole formed in the body to receive the connection terminal; and a substrate support unit coupled to the housing unit and configured to support the first end of the substrate on which the electrode pad is formed and exposed to an exterior of the housing unit, the substrate support unit including an inserting ledge formed on the substrate support unit to be inserted into an elasticity-providing groove of the another lighting apparatus.

According to the present invention, two adjoining lighting apparatuses are coupled with each other by vertical insertion, and therefore, the connection between adjoining lighting apparatuses can be eased and secured.

DETAILED DESCRIPTION

A more complete appreciation of the invention, and many of the attendant advantages thereof, will be readily apparent as the same becomes better understood by reference to the following detailed description when considered in conjunction with the accompanying drawings in which like reference symbols indicate the same or similar components.

Hereinafter, specific embodiments of a lighting apparatus will be described with reference to FIGS. 1 to 12. However, the following description and drawings are only exemplary and the present invention is not limited by them.

In the following description of the present invention, a detailed description of known functions and configuration incorporated herein will be omitted when it may make the subject matter of the present invention rather unclear. Terms which will be later are defined on the basis of the entire contents of the present specification.

Figure 1:
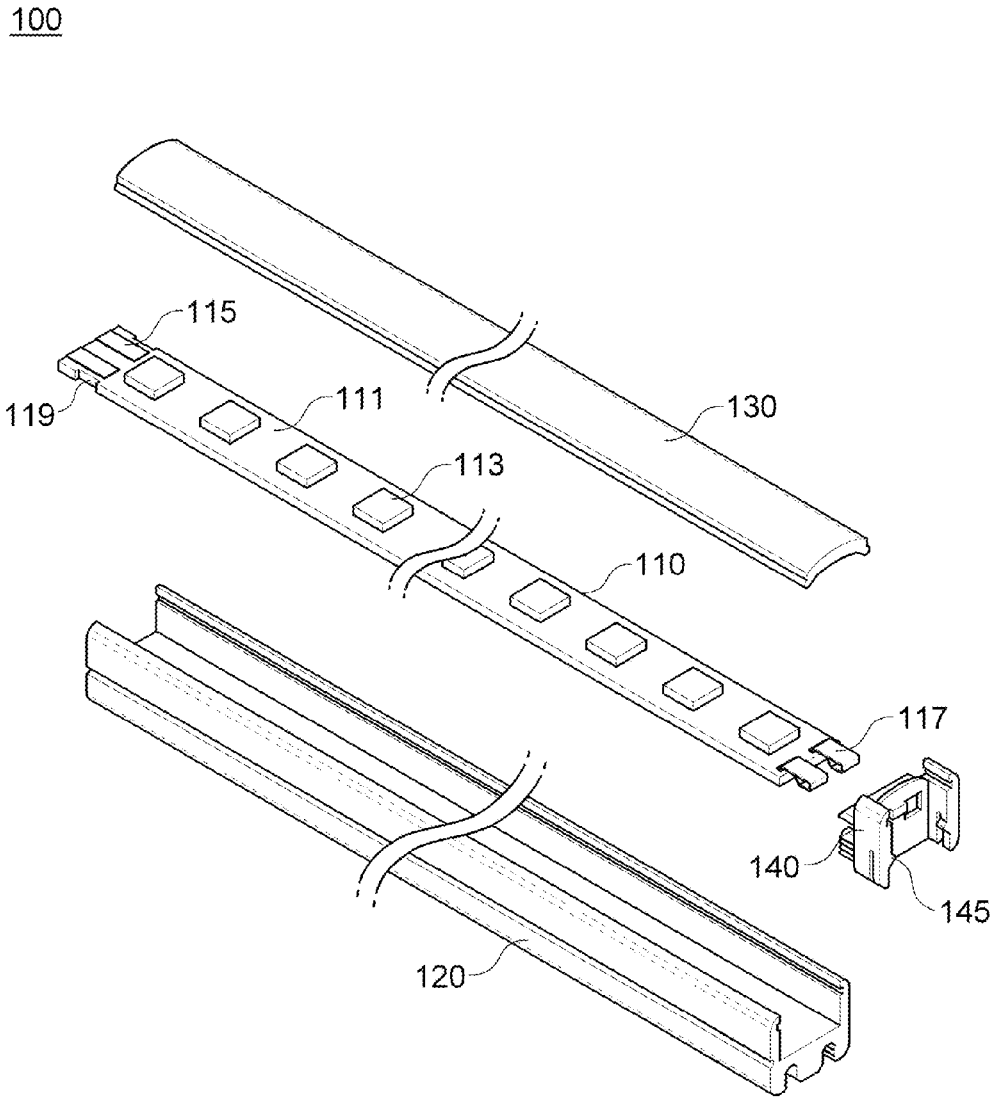
FIG. 1 is an exploded perspective view of a lighting apparatus according to an embodiment of the present invention.
Figure 2:
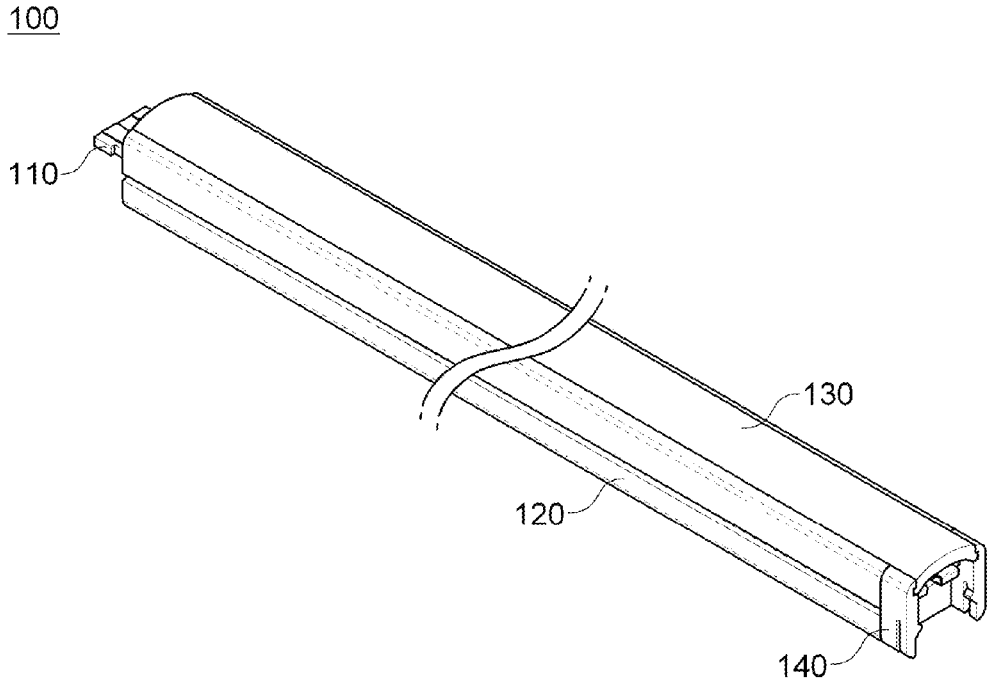
FIG. 2 is a perspective view of an assembled lighting apparatus according to an embodiment of the present invention.

FIG. 1 is an exploded perspective view of a lighting apparatus, and FIG. 2 is a perspective view of an assembled lighting apparatus according to an embodiment of the present invention.

Referring FIG. 1 and FIG. 2, a lighting apparatus 100 includes a lighting unit 110, a housing unit 120, a diffusing unit 130, and a coupling unit 140.

The lighting unit 110 includes a substrate 111, a plurality of light emitting elements 113, an electrode pad 115, and a connection terminal 117. The substrate 111 may be, for example, a printed circuit board, and can be shaped as a bar. The light emitting elements 113 are attached on the substrate 111, each of them are spaced apart from one another on the substrate 111. For example, the light emitting elements 113 can be arranged to be evenly spaced on the substrate 111. However, the present invention is not limited to specific arrangement structure and the light emitting elements 113 can be variously arranged. The electrode pad 115 is formed at one end (which is also referred to as "a first end") of the lighting apparatus 100, and the connection terminal 117 is formed at the other end (which is also referred to as "a second end") of the lighting apparatus 100.

The light emitting elements 113 generate light by transforming electric energy to light energy. For example, LEDs (light emitting diodes) or OLEDs (organic light emitting diodes) can be used as the light emitting elements 113.

The electrode pad 115 is formed at one end of the substrate 111. The electrode pad 115 includes a plus (+) electrode and a minus (−) electrode. The electrode pad 115 is electrically coupled to each of the light emitting elements 113.

The one end of the substrate 111 (where the electrode pad 115 is formed) is exposed to an exterior of the housing unit 120 for connection with another lighting apparatus. In other words, the electrode pad 115 is exposed to the exterior of the housing unit 120 at the one end of the lighting apparatus 100. Locking grooves 119 may be formed on both side of the substrate 111 in the vicinity of the exposed electrode pad 115.

The connection terminal 117 is formed at the other end of the substrate 111. The connection terminal 117 is electrically coupled with an electrode pad of adjoining lighting apparatus (not shown). The housing unit 120 houses the lighting unit 110. In this case, the lighting unit 110 can be coupled with the housing unit 120 by adhesives or any other coupling device.

The diffusing unit 130 is coupled with the housing unit 120 atop the lighting unit 110. The diffusing unit 130 may be slidably coupled to the housing unit 120. However, the present invention is not limited to a specific coupling method, and various methods can be applied to couple the diffusing unit 130 with the housing unit 120. The diffusing unit 130 is configured to diffuse light generated from the light emitting elements 113.

The coupling unit 140 is coupled to the housing unit 120 at the other end of the lighting apparatus 100. In other words, the coupling unit 140 is coupled with the housing unit 120 and with the diffusing unit 130 at the other end of the substrate 111.

The coupling unit 140 is for providing firm connection with another lighting apparatus (not shown). When the lighting apparatus 100 is coupled to another lighting apparatus, a locking ledge 145 which protrudes inwardly from an inside surface of the coupling unit 140 is locked into a locking groove of another lighting apparatus.

The electrode pad 115 of the lighting apparatus 100 is electrically connected with a connection terminal of adjoining lighting apparatus (not shown) through a coupling unit of the adjoining lighting apparatus. More detailed description will be followed later.

Figure 3:
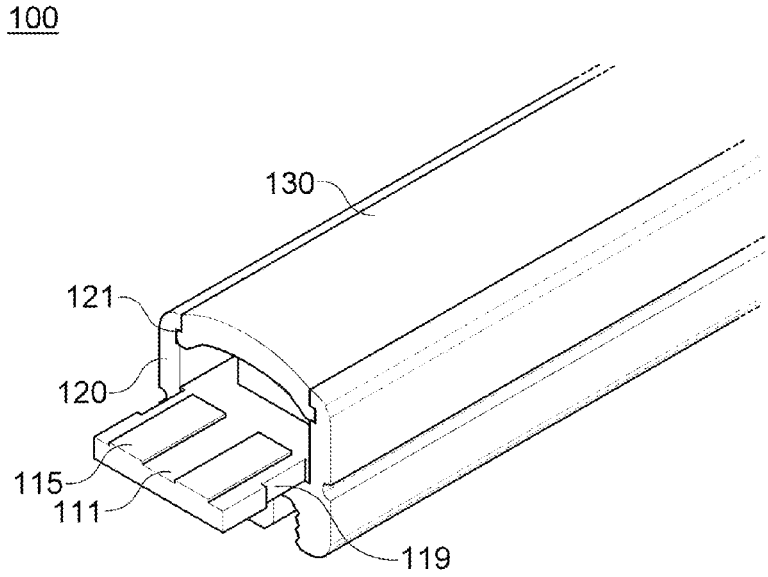
FIG. 3 is a perspective view of one end of a lighting apparatus according to an embodiment of the present invention.

FIG. 3 is a perspective view of one end of a lighting apparatus according to an embodiment of the present invention.

Referring FIG. 3, one end of substrate 111 in which an electrode pad 115 is formed is protruded and exposed to an exterior of a lighting apparatus 100. Locking grooves 119 are formed on both side of the exposed substrate 111. Locking ledges of another lighting apparatus are locked into the locking grooves 119.

A first guiding groove 121 is formed at an upper inside surface of the housing unit 120, and a diffusing unit 130 is slidably coupled to the housing unit 120 through the first guiding groove 121.

Figure 4:
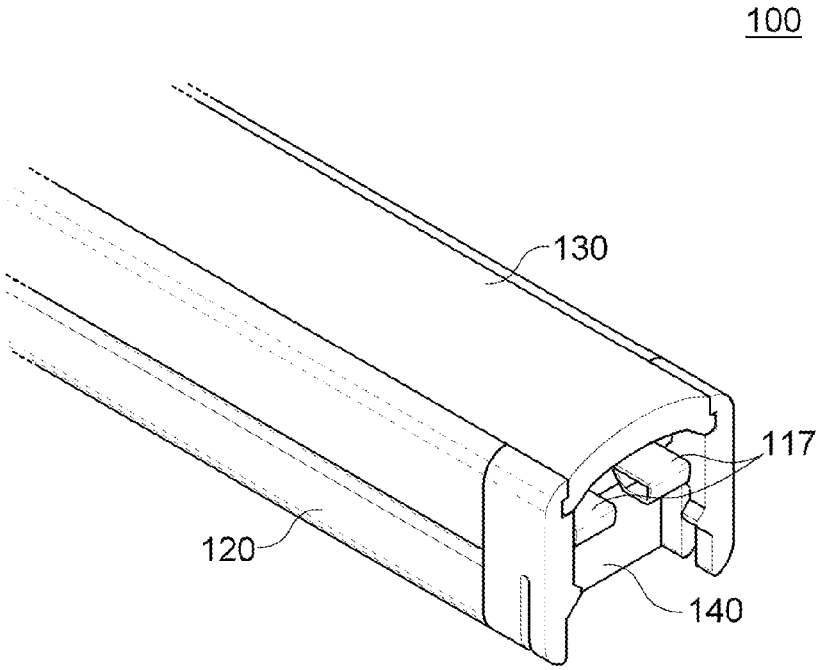
FIG. 4 is a perspective view of the other end of a lighting apparatus according to an embodiment of the present invention.
Figure 5:
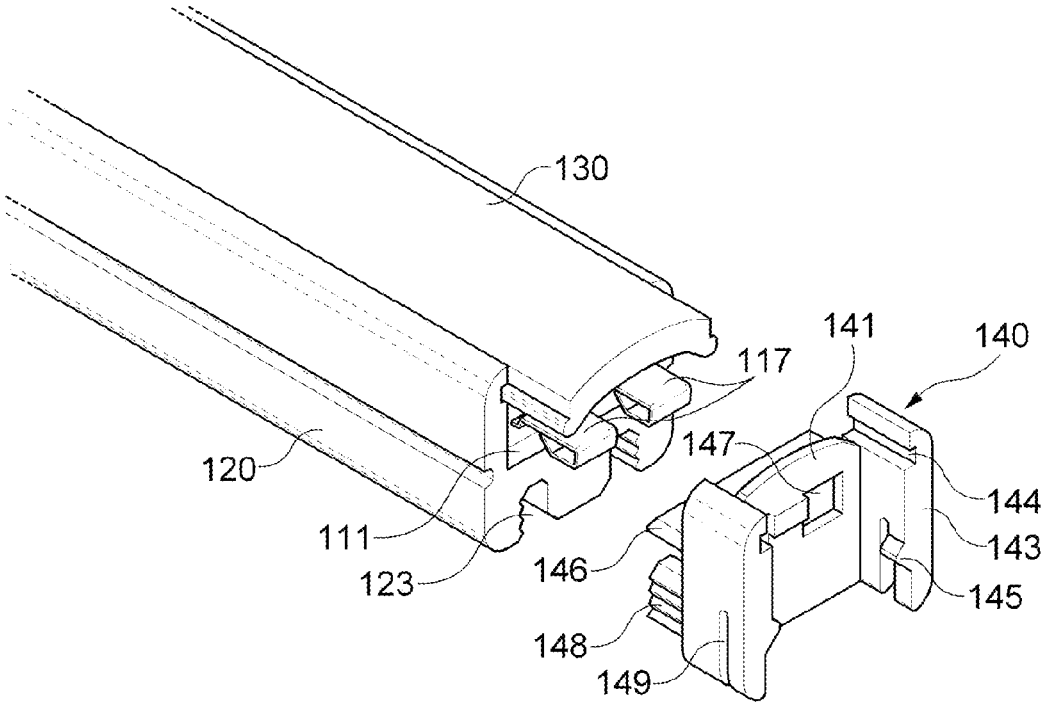
FIG. 5 is a perspective view for describing connection between a coupling unit and the other end of the lighting apparatus according to an embodiment of the present invention.
Figure 6:
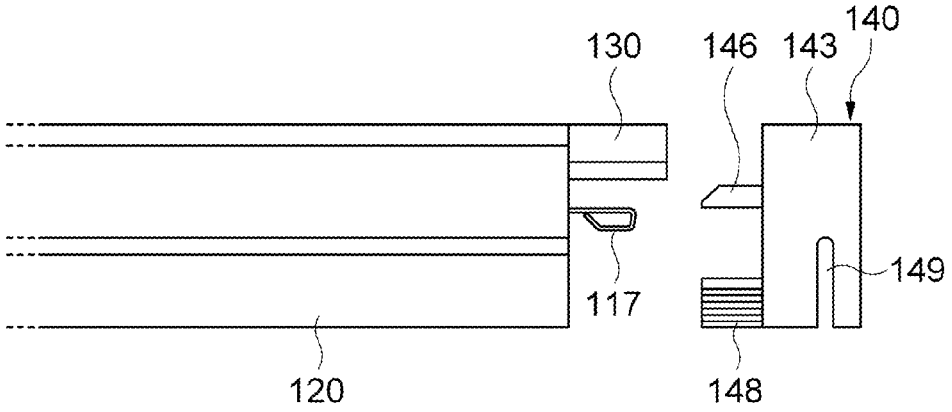
FIG. 6 is a lateral view for describing connection between the coupling unit and the other end of the lighting apparatus, according to an embodiment of the present invention.

FIG. 4 is a perspective view of the other end of a lighting apparatus, FIG. 5 is a perspective view for describing connection between a coupling unit and the other end of the lighting apparatus, and FIG. 6 is a lateral view for describing connection between the coupling unit and the other end of the lighting apparatus, according to an embodiment of the present invention.

Referring FIGS. 4 to 6, a coupling unit 140 is coupled with a housing unit 120 and with a diffusing unit 130 at the other end of lighting apparatus 100. The coupling unit 140 includes a body 141, a pair of lateral projections 143, a guide support 146, and a coupling ledge 148.

The pair of lateral projections 143 protrudes vertically in a forward direction from both sides of the body 141. Two locking ledges 145 are formed on an inner surface of each of the lateral projections 143. The locking ledges 145 are locked into locking grooves of another lighting apparatus when the lighting apparatus 100 is coupled to another lighting apparatus. A second guiding groove 144 is formed at an upper inside surface of the pair of lateral projections 143. A diffusing unit 130 is slidably coupled to the second guiding groove 144.

Elasticity-providing grooves 149 are formed on each of the lateral projections 143. The elasticity-providing grooves 149 provide elasticity to the lateral projections 143 so that each of the lateral projections 143 stretch outwardly when the locking ledge 145 is locked into a locking groove of another lighting apparatus. Therefore, the locking ledge 145 can be easily and stably coupled to the locking groove of another lighting apparatus.

A connection terminal inserting hole 147 penetrates through the body 141. A connection terminal 117 is inserted into the connection terminal inserting hole 147 and is exposed to the exterior of the lighting apparatus 100.

The guide support 146 is protruded perpendicularly to the body in a backward direction from the body 141. The guide support 146 guides and supports the connection terminal 117 when the connection terminal 117 is inserted into the connection terminal inserting hole 147.

The coupling ledge 148 protrudes perpendicularly to the body in a backward direction from a lower part of the body 141. The coupling ledge 148 is inserted into a coupling groove 123 which is formed at a lower part of the housing unit 120.

As described above, the coupling unit 140 is coupled to the diffusing unit 130 when the sides of the diffusing unit 130 is inserted into the second guiding groove 144, and the coupling unit 140 is coupled to the housing unit 120 when the coupling ledge 148 is inserted into the coupling groove 123 of the housing unit 120. The connection terminal 117 is inserted into the connection terminal inserting hole 147 and exposed to the outside of lighting apparatus 100.

Figure 7:
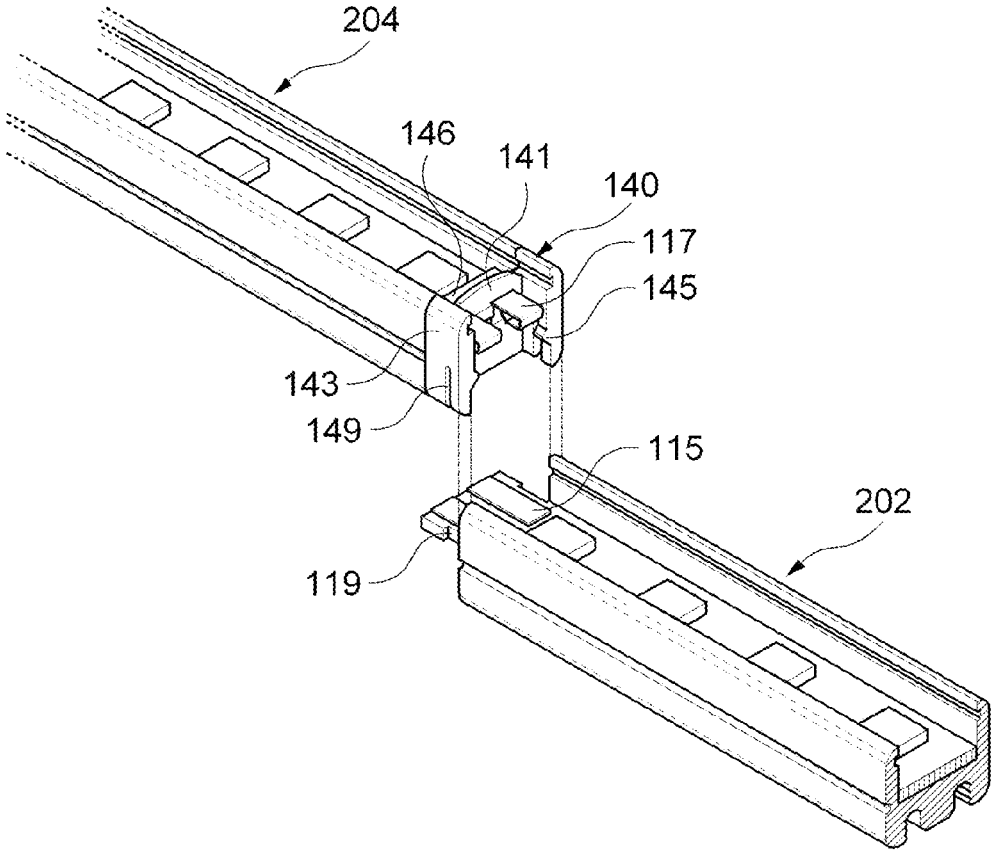
FIG. 7 is a perspective view for describing connection of two lighting apparatuses.
Figure 8:
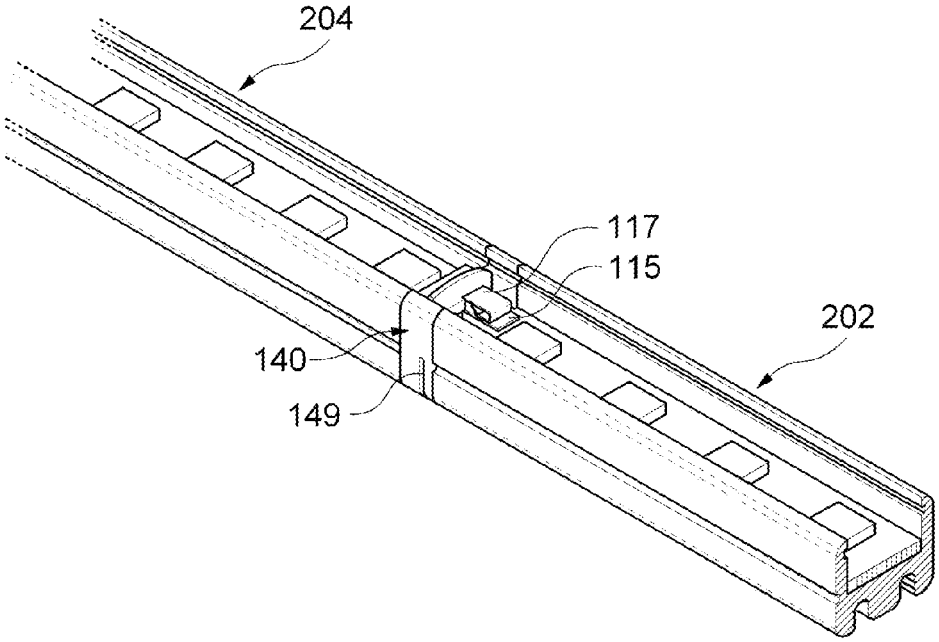
FIG. 8 is a perspective view of connected two lighting apparatuses according an embodiment of to the present invention.

FIG. 7 is a perspective view for describing connection of two lighting apparatuses, and FIG. 8 is a perspective view of connected two lighting apparatuses according an embodiment of to the present invention. In FIG. 8, diffusing units of each of the lighting apparatuses are omitted for clearly illustrate the connection.

Referring FIGS. 7 and 8, one end of a first lighting apparatus 202 is coupled to the other end of a second lighting apparatus 204. In other words, the first lighting apparatus 202 and the second lighting apparatus 204 are connected serially. Illustrated herein is an example of connection of two lighting apparatuses, however, it is apparent from the drawings that more than two lighting apparatuses can be connected serially.

At first, the other end of the second lighting apparatus 204 is positioned above the one end of the first lighting apparatus 202. In this case, each of locking ledges 145 of the second lighting apparatus 204 are positioned corresponding to each of locking grooves 119 of the first lighting apparatus 202.

Next, the other end of the second lighting apparatus 204 is pressed down to be connected with the one end of the first lighting apparatus 202. Specifically, when the other end of the second lighting apparatus 204 is pressed down, the locking ledge 145 of the second lighting apparatus 204 passes through the locking groove 119 of the first lighting apparatus 202 and is snap locked.

Here, when the locking ledge 145 of the second lighting apparatus 204 passes through the locking groove 119 of the first lighting apparatus 202, a lateral projection 143 is flexed outwardly because of a elasticity-providing groove 149, so the locking ledge 145 can be easily locked into the locking groove 119. In this case, the coupling between the two lighting apparatuses can be eased and secured due to the locking groove 119 of the first lighting apparatus 202 and the locking ledge 145 of the second lighting apparatus 204.

When the other end of the second lighting apparatus 204 is coupled to the one end of the first lighting apparatus 202, a connection terminal 117 of the second lighting apparatus 204 electrically contacts an electrode pad 115.

According to an embodiment of the present invention, two adjoining lighting apparatuses are coupled with each other by vertical insertion. Therefore, the connection between adjoining lighting apparatuses can be eased and secured.

Figure 9:
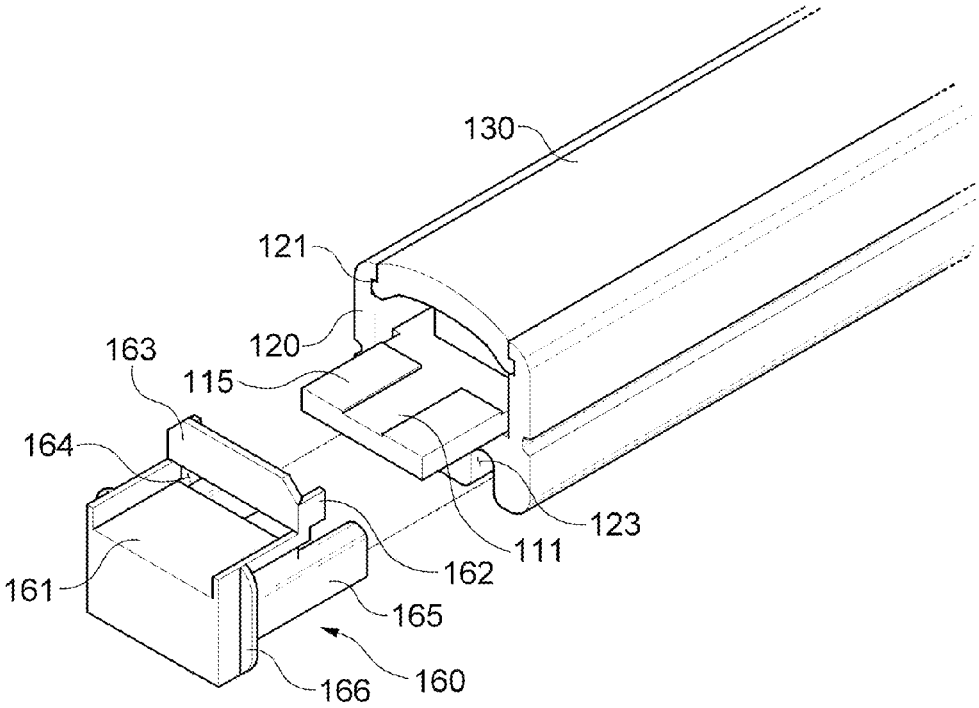
FIG. 9 is a perspective view for describing a substrate support unit which is attached to one end of a lighting apparatus according to another embodiment of the present invention.
Figure 10:
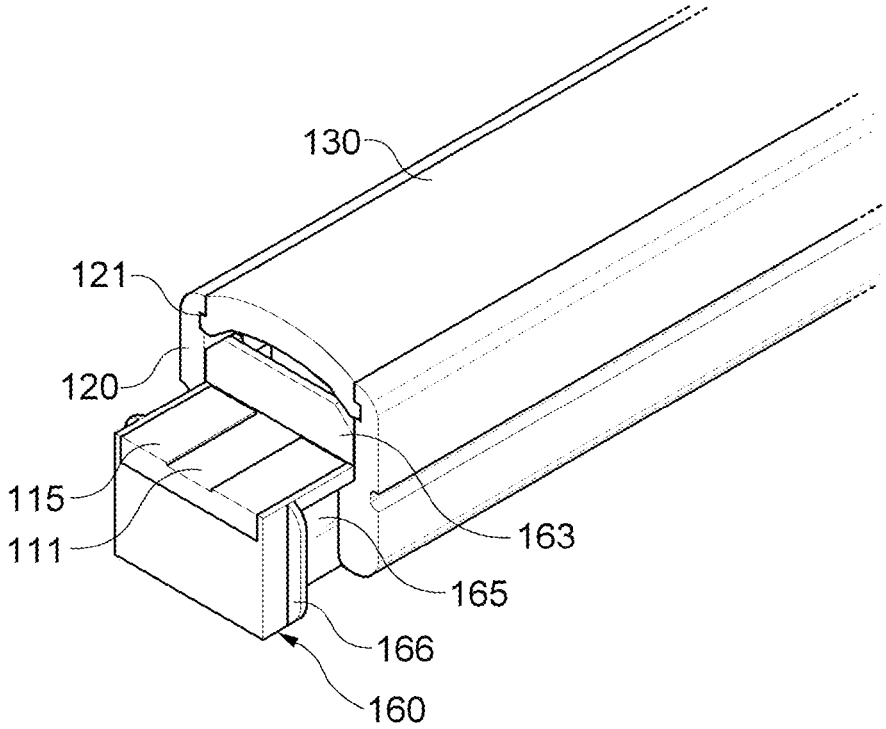
FIG. 10 is a perspective view of a lighting apparatus according to another embodiment of the present invention.

FIG. 9 is a perspective view for describing a substrate support unit which is attached to one end of a lighting apparatus according to another embodiment of the present invention, and FIG. 10 is a perspective view of a lighting apparatus according to another embodiment of the present invention. In this embodiment, a substrate support unit is coupled to one end of a lighting apparatus. When a first lighting apparatus is coupled to adjoining second lighting apparatus, a substrate support unit which is formed at one end of the first lighting apparatus is vertically inserted into a coupling unit which is formed at other end of the second lighting apparatus.

Referring FIGS. 9 and 10, a substrate support unit 160 is coupled to a housing unit 120 at one end of a lighting apparatus 100. The substrate support unit 160 stably supports one end of a substrate 111 which is exposed to an exterior of the lighting apparatus 100. Here, an electrode pad 115 is formed on an upper surface of the one end of the substrate 111.

The substrate support unit 160 includes a substrate seat 161, a pair of guiding members 162, a guiding member connector 163, a substrate inserting hole 164, a second coupling ledge 165, and an inserting ledge 166. In the specification and the claims, the fact that the parts are separately named does not necessarily mean that the parts are separately formed. In other words, the parts may be integrally formed. For example, even if the guiding members 162 and the guiding member connector 163 are separately named, the guiding members 162 and the guiding member connector 163 may be integrally formed.

The substrate seat 161 constitutes a body of the substrate support unit 160. The substrate seat 161 supports the one end of the substrate 111 which is exposed to an exterior of the housing unit 120. Here, the one end of the substrate 111 is placed at an upper surface of the substrate seat 161.

The pair of guiding members 162 protrudes from both sides of an upper rear surface of the substrate support unit 160. The pair of guiding members 162 is coupled to the housing unit 120 by being inserted into an inside of the housing unit 120. However, the present invention is not limited the above description. For example, the pair of guiding members 162 can be configured to be inserted into an outside of the housing unit 120 as well.

The guiding member connector 163 connects each of the guiding members 162. The guiding member connector 163 also supports the pair of the guiding members 162.

The substrate inserting hole 164 is formed at a lower part of the guiding member connector 163. When the substrate support unit 160 is coupled to the housing unit 120, the one end of the substrate 111 which is exposed at the exterior or the housing unit 120 is inserted into the substrate inserting hole 164 and placed at the upper surface of the substrate seat 161.

The second coupling ledge 165 protrudes from both sides of a lower rear surface of the substrate support unit 160. The second coupling ledge 165 is inserted into a coupling groove 123 which is formed at a lower part of the housing unit 120. As described above, the substrate support unit 160 is coupled to the housing unit 120 through the pair of guiding members 162 and the second coupling ledge 165.

The inserting ledge 166 protrudes from each side of the substrate seat. The inserting ledge is inserted into an elasticity-providing groove 149 of another lighting apparatus when the lighting apparatus 100 is coupled to another lighting apparatus.

A lighting apparatus 100 according to the present invention can be installed, for example, on a ceiling or a wall with a bracket which is attached to a bottom of a housing unit 120. If the ceiling or wall includes metal such as iron, a magnet can be used to easily install the lighting apparatus 100.

For example, a coupling groove 123 is formed at a lower part of the housing unit 120. Here, the coupling groove 123 can be extended from one end of the housing unit 120 to the other end, and one or more magnets can be inserted into the coupling groove 123 so that the lighting apparatus 100 can be easily installed on a metal surface. The magnets can be inserted without adhesion means when the housing unit 120 is made of metal. Or, if the housing unit 120 is non-metallic, the magnets can be attached using adhesives or any other coupling means.

Figure 11:
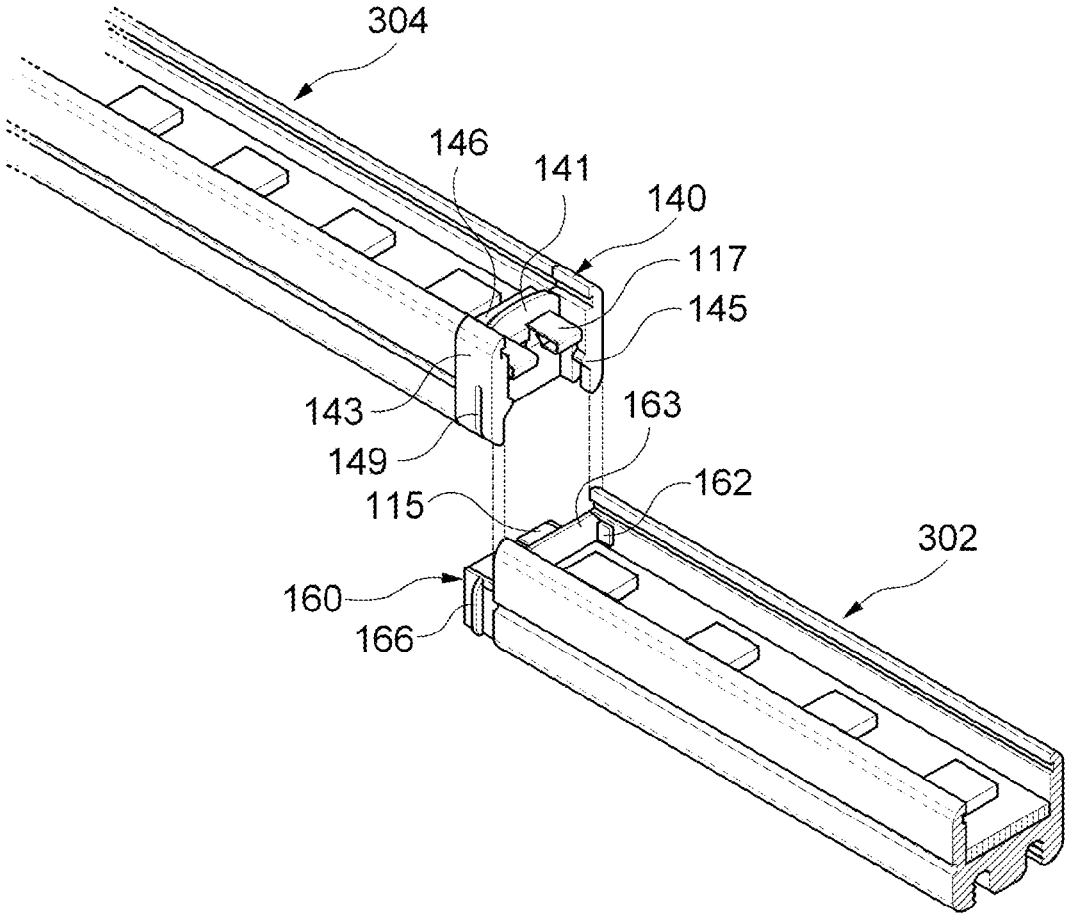
FIG. 11 is a perspective view for describing connection of two lighting apparatuses according to another embodiment of to the present invention.
Figure 12:
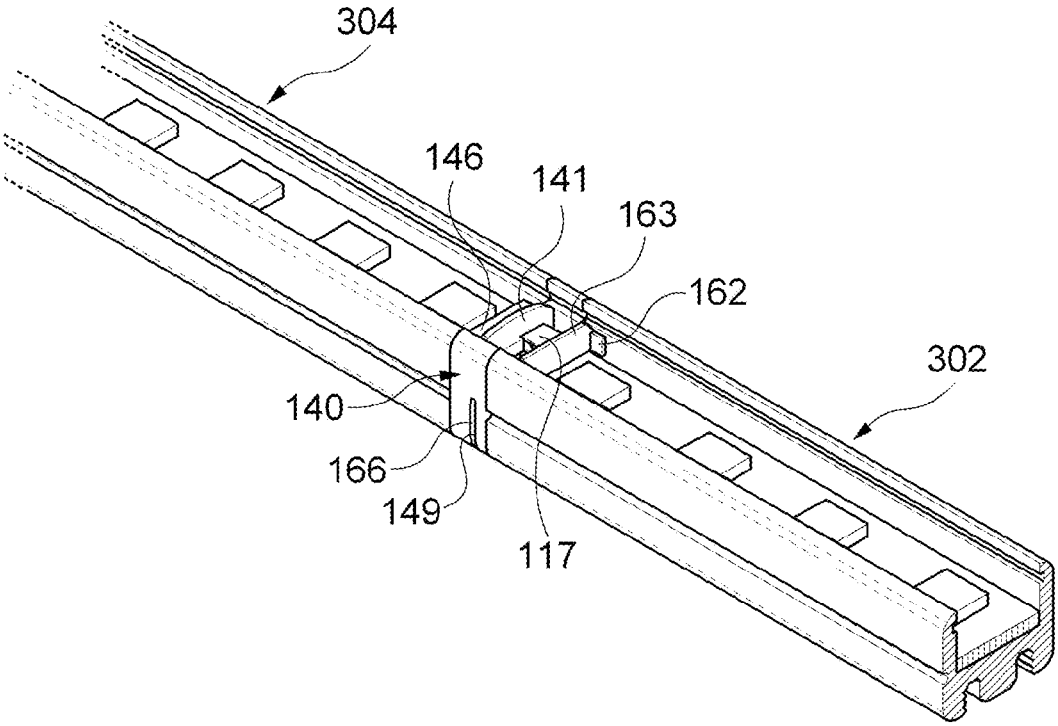
FIG. 12 is a perspective view of connected two lighting apparatuses according to another embodiment of to the present invention.

FIG. 11 is a perspective view for describing connection of two lighting apparatuses, and FIG. 12 is a perspective view of connected two lighting apparatuses according to another embodiment of to the present invention.

Referring FIGS. 11 and 12, a substrate support unit 160 is coupled to a first lighting apparatus 302, and a coupling unit 140 is coupled to a second lighting apparatus 304. Here, the one end of the first lighting apparatus 302 is coupled to the other end of a second lighting apparatus 304, and the first lighting apparatus 302 and the second lighting apparatus 304 are connected serially.

At first, the other end of the second lighting apparatus 304 is positioned above the one end of the first lighting apparatus 302. In this case, an elasticity-providing groove 149 of the second lighting apparatus 304 is positioned corresponding to an inserting ledge 166 of the first lighting apparatus 302.

Next, press the other end of the second lighting apparatus 304 down to connect with the one end of the first lighting apparatus 302. Specifically, when the other end of the second lighting apparatus 304 is pressed down, the inserting ledge 166 of the first lighting apparatus 302 is inserted into the elasticity-providing groove 149 of the second lighting apparatus 304. Here, a locking ledge 145 of the second lighting apparatus 304 is tightly coupled to a side of a substrate seat 161.

When the other end of the second lighting apparatus 304 is coupled to the one end of the first lighting apparatus 302, a connection terminal 117 of the second lighting apparatus 304 electrically contacts an electrode pad 115 of the first lighting apparatus 302.

As described above, although the preferable embodiments of the present invention have been shown and described, it will be appreciated by those skilled in the art that substitutions, modifications and variations may be made in these embodiments without departing from the principles and spirit of the general inventive concept, the scope of which is defined in the appended claims and their equivalents.

What is claimed is:

1. A lighting apparatus for use in combination with another lighting apparatus, comprising:

a lighting unit comprising a substrate having a first end and a second end opposite to the first end, a light emitting element formed on the substrate, an electrode pad formed at the first end of the substrate, and a connection terminal formed at the second end of the substrate;

a housing unit that houses the lighting unit; and a coupling unit coupled to the housing unit at the second end of the substrate;

wherein the lighting apparatus is vertically inserted to the another lighting apparatus through the coupling unit.

2. The lighting apparatus of claim 1, wherein the first end of the substrate with the electrode pad is exposed to an exterior of the housing unit, a locking groove is formed on a side of the exposed first end of the substrate, and the coupling unit is coupled to the locking groove of the another lighting apparatus.

3. The lighting apparatus of claim 2, wherein the housing unit comprises a coupling groove formed at a lower part of the housing unit, and the coupling unit has a coupling ledge inserted into the coupling groove.

4. The lighting apparatus of claim 1, further comprises a diffusing unit to diffuse light generated from the light emitting element, wherein the housing unit has a first guiding groove formed at an upper part of the housing unit, and the diffusing unit is coupled to the first guiding groove.

5. The lighting apparatus of claim 3, wherein the coupling unit comprises:

a body;

a pair of lateral projections facing each other and protruding from both sides of the body in a direction opposite to the housing unit;

two locking ledges facing each other and formed on an inner surface of each of the lateral projections;

a connection terminal inserting hole formed in the body, wherein the connection terminal is inserted into the connection terminal inserting hole and is exposed to the exterior of the housing unit; and the coupling ledge protruding from the body toward the housing unit, the coupling ledge inserted into the coupling groove.

6. The lighting apparatus of claim 5, wherein the coupling unit further comprises an elasticity-providing groove formed on each of the lateral projections to provide elasticity to the lateral projections.

7. The lighting apparatus of claim 5, wherein the coupling unit further comprises a guide support that protrudes from the body toward the substrate, and configured to guide and support the connection terminal when the connection terminal is inserted into the connection terminal inserting hole.

8. The lighting apparatus of claim 1, wherein the lighting apparatus further comprises a substrate support unit coupled to the housing unit, and configured to support the first end of the substrate on which the electrode pad is formed and exposed to an exterior of the housing unit.

9. The lighting apparatus of claim 8, wherein the housing unit comprises a coupling groove formed at a lower part of the housing unit, and a first guiding groove formed at an upper surface of the housing unit.

10. The lighting apparatus of claim 9, wherein the coupling unit comprises:

a body;

a pair of lateral projections facing each other and protruding from both sides of the body in a direction opposite to the housing;

two locking ledges facing each other and formed on an inner surface of each of the lateral projections;

an elasticity-providing groove formed on each of the lateral projections to provide elasticity to the lateral projections;

a connection terminal inserting hole formed in the body, wherein the connection terminal is inserted into the connection terminal inserting hole and is exposed to the exterior of the housing unit; and a first coupling ledge protruding from the body toward the housing unit, the first coupling ledge inserted into the coupling groove.

11. The lighting apparatus of claim 10, wherein the coupling unit further comprises a guide support that protrudes from the body toward the substrate, and configured to guide and support the connection terminal when the connection terminal is inserted into the connection terminal inserting hole.

12. The lighting apparatus of claim 10, wherein the substrate support unit comprises:

a substrate seat that supports a lower surface of the first end of the substrate which is exposed to an exterior of the housing unit;

a second coupling ledge protruding from the substrate support unit toward the housing unit and inserted into the coupling groove; and an inserting ledge formed in each side of the substrate seat to be inserted into an elasticity-providing groove of the another lighting apparatus.

13. The lighting apparatus of claim 12, wherein the substrate support unit further comprises:

a pair of guiding members protruding from both sides of an upper rear surface of the substrate support unit toward the housing unit; and a guiding member connector that connects the pair of the guiding members to each other.

14. The lighting apparatus of claim 9, further comprising a diffusing unit to diffuse light generated from the light emitting element, the diffusing unit coupled to the first guiding groove.

15. The lighting apparatus of claim 1, further comprising a magnet attached to a lower part of the housing unit.

16. A lighting apparatus for use in combination with another lighting apparatus, comprising:

a lighting unit comprising:

a substrate having a first end and a second end opposite to the first end, the substrate having a pair of locking grooves formed on both side of the substrate in the vicinity of the first end;

a light emitting element formed on the substrate;

an electrode pad formed at the first end of the substrate; and a connection terminal formed at the second end of the substrate;

a housing unit that houses the lighting unit; and a coupling unit coupled to the housing unit at the second end of the substrate, the coupling unit comprises:

a body;

a pair of lateral projections protruding from both sides of the body in a direction opposite to the housing;

a pair of locking ledges facing each other and protruding horizontally on the lateral projections to be coupled to a pair of locking grooves of another lighting apparatus; and a connection terminal inserting hole formed in the body to receive the connection terminal.

17. The lighting apparatus of claim 16, wherein the coupling unit further comprises an elasticity-providing groove formed on each of the lateral projections to provide elasticity to the lateral projections.

18. A lighting apparatus for use in combination with another lighting apparatus, comprising:

a lighting unit comprising:

a substrate having a first end and a second end opposite to the first end;

a light emitting element formed on the substrate;

an electrode pad formed at the first end of the substrate; and a connection terminal formed at the second end of the substrate;

a housing unit that houses the lighting unit;

a coupling unit coupled to the housing unit at the second end of the substrate, the coupling unit comprises:

a body;

a pair of lateral projections protruding from both sides of the body in a direction opposite to the housing;

an elasticity-providing groove formed on each of the lateral projections to provide elasticity to the lateral projections; and a connection terminal inserting hole formed in the body to receive the connection terminal; and a substrate support unit coupled to the housing unit and configured to support the first end of the substrate on which the electrode pad is formed and exposed to an exterior of the housing unit, the substrate support unit comprising an inserting ledge formed on the substrate support unit to be inserted into an elasticity-providing groove of the another lighting apparatus.

19. The lighting apparatus of claim 18, wherein the substrate has a pair of locking grooves formed on both side of the substrate in the vicinity of the first end, and the coupling unit has a pair of locking ledges facing each other and protruding horizontally on the lateral projections to be coupled to a pair of locking grooves of another lighting apparatus.

* * * * *